US005083398A

United States Patent [19]

Kolbeck et al.

[11] Patent Number: 5,083,398

[45] Date of Patent: Jan. 28, 1992

[54] REMOTE WINDOW LOCK

[75] Inventors: John P. Kolbeck, Schofield; Kevin R. Sasman, Wausau, both of Wis.

[73] Assignee: Wausau Metals Corporation, Wausau, Wis.

[21] Appl. No.: 687,591

[22] Filed: Apr. 17, 1991

[51] Int. Cl.[5] ..... E05C 9/00; E06B 3/34

[52] U.S. Cl. ..... 49/395; 49/390; 292/37; 292/165; 292/169

[58] Field of Search ..... 49/395, 390, 394; 292/32, 37, 34, 35, 165, 169

[56] References Cited

U.S. PATENT DOCUMENTS

| | | | |
|---|---|---|---|
| 1,124,821 | 1/1915 | Smolensky . | |
| 1,621,740 | 3/1927 | Pavola . | |
| 1,794,171 | 2/1931 | Grutel . | |
| 2,117,269 | 5/1938 | Beil | 49/390 X |
| 2,231,647 | 2/1941 | Warren et al. | 292/37 X |
| 2,486,460 | 11/1949 | Bonenberger . | |
| 2,562,581 | 7/1951 | Schaefer . | |
| 2,584,088 | 1/1952 | Floyd . | |
| 2,612,396 | 9/1952 | Venditty . | |
| 3,474,572 | 10/1969 | Rothemund | 49/390 |
| 3,498,657 | 3/1970 | Fontana . | |
| 3,670,537 | 6/1972 | Horgan, Jr. . | |
| 3,706,164 | 12/1972 | Glause et al. | 49/394 |
| 3,731,962 | 5/1973 | Enochian . | |
| 3,911,623 | 10/1975 | Walter | 49/394 X |
| 3,953,061 | 4/1976 | Hansen et al. . | |
| 4,227,723 | 10/1980 | Rosell . | |
| 4,422,313 | 12/1983 | VanderWyde . | |
| 4,587,759 | 5/1986 | Gray . | |
| 4,803,808 | 2/1989 | Greisner . | |
| 4,807,914 | 2/1989 | Fleming et al. . | |

*Primary Examiner*—Philip C. Kannan
*Attorney, Agent, or Firm*—Lathrop & Clark

[57] ABSTRACT

A remote lock assembly for vertically pivoting windows has two resilient catches mounted in the vertical stile of a window sash one above the other. Opposite the lower catch is a cam housing with a recess in which the lower catch is engaged when the window is in a locked position and containing a cam which, when rotated, rides against the catch to force the catch out of the cam housing to unlock the window. A flapper housing is mounted in the window jamb and has a recess for engaging the second catch. A flapper is pivotally mounted to the flapper housing and pivots between a locked position in which the flapper does not block the housing recess and an unlocked position in which it blocks the housing recess and forces the opposing catch out of the flapper housing recess. A link connects the cam to a bar which slidably extends into the flapper housing. The bar has a protrusion which engages the flapper, such that rotation of the cam operates to disengage both catches from the window jamb.

15 Claims, 6 Drawing Sheets

REMOTE WINDOW LOCK

FIELD OF THE INVENTION

This invention relates generally to latches and locks and particularly to locks for vertically pivoting windows.

BACKGROUND OF THE INVENTION

Vertically pivoted windows are commonly used in commercial buildings where windows are not used for routine ventilation but for transmission of light and for decorative purposes. In normal use, the windows are held securely in a closed position at a number of locking points. On large pivot windows, multiple locking points are required. To ensure a tight seal, a tall window sash will require locking points which are substantially elevated above the floor. These elevated locking points require an operator to mount a stool or ladder to open the window. Although the vertically pivoted window will remain closed throughout much of a year, it must be opened occasionally for emergency ventilation and for routine cleaning of the window panes.

Conventionally, each locking point requires a separate key for opening the lock. For ease of operation and convenience, a mechanism is needed for vertically pivoting windows which allows safe and economical operation of multiple locking points without the operator leaving the floor.

SUMMARY OF THE INVENTION

The remote window lock assembly for vertically pivoting windows of this invention allows for the releasable locking of the window in the closed position at two sites while keeping the other locking points where they are needed.

The remote window lock assembly has at least two resilient catches which are adapted for mounting to the vertical stile of a window sash.

A cam housing is adapted for mounting into the window frame opposite the catch in the window sash. The cam housing has portions defining a recess for the engagement of the opposite catch when the sash is in a closed position. A cam is located within the cam housing and rotatable between a locked position in which the catch is permitted to engage within the recess and an unlocked position in which portions of the cam force the catch out of the cam housing and out of engagement within the recess.

A flapper housing is adapted for mounting into the window frame above the cam housing and opposite a catch in the window sash. The flapper housing has portions defining a recess and is adapted to engage and hold the opposite catch. A flapper is pivotally mounted to the flapper housing and pivots between a locked position in which the flapper does not block the flapper housing recess and an unlocked position in which the flapper blocks the flapper housing recess. In the unlocked position, the flapper forces the opposite catch out of engagment with the flapper housing.

A link is pivotally connected to the cam and extends upwardly out of the cam housing. A bar is pivotally connected to the link above the cam housing and slidably extends into the flapper housing. The bar has a protrusion on it which extends horizontally and engages the flapper. The bar is slidable from a locked and elevated position in which the flapper is in the locked position to an unlocked lowered position in which the bar protrusion presses against the flapper, pivoting the flapper into its unlocked position. The rotation of the cam from its locked to its unlocked position moves the bar from its elevated to its lowered position. The cam is rotated by the use of a key or a handle to cause the locking and unlocking of the window.

It is an object of the present invention to provide a mechanism for pivot windows which allows multiple locking points to be locked and unlocked from a central, conveniently positioned location.

It is also an object of the present invention to provide a remotely operable window lock of simple and sturdy construction.

Further objects, features, and advantages of the invention will be apparent from the following detailed description taken in conjunction with the accompanying drawings.

DESCRIPTION OF THE PREFERRED EMBODIMENT

Figure 1:
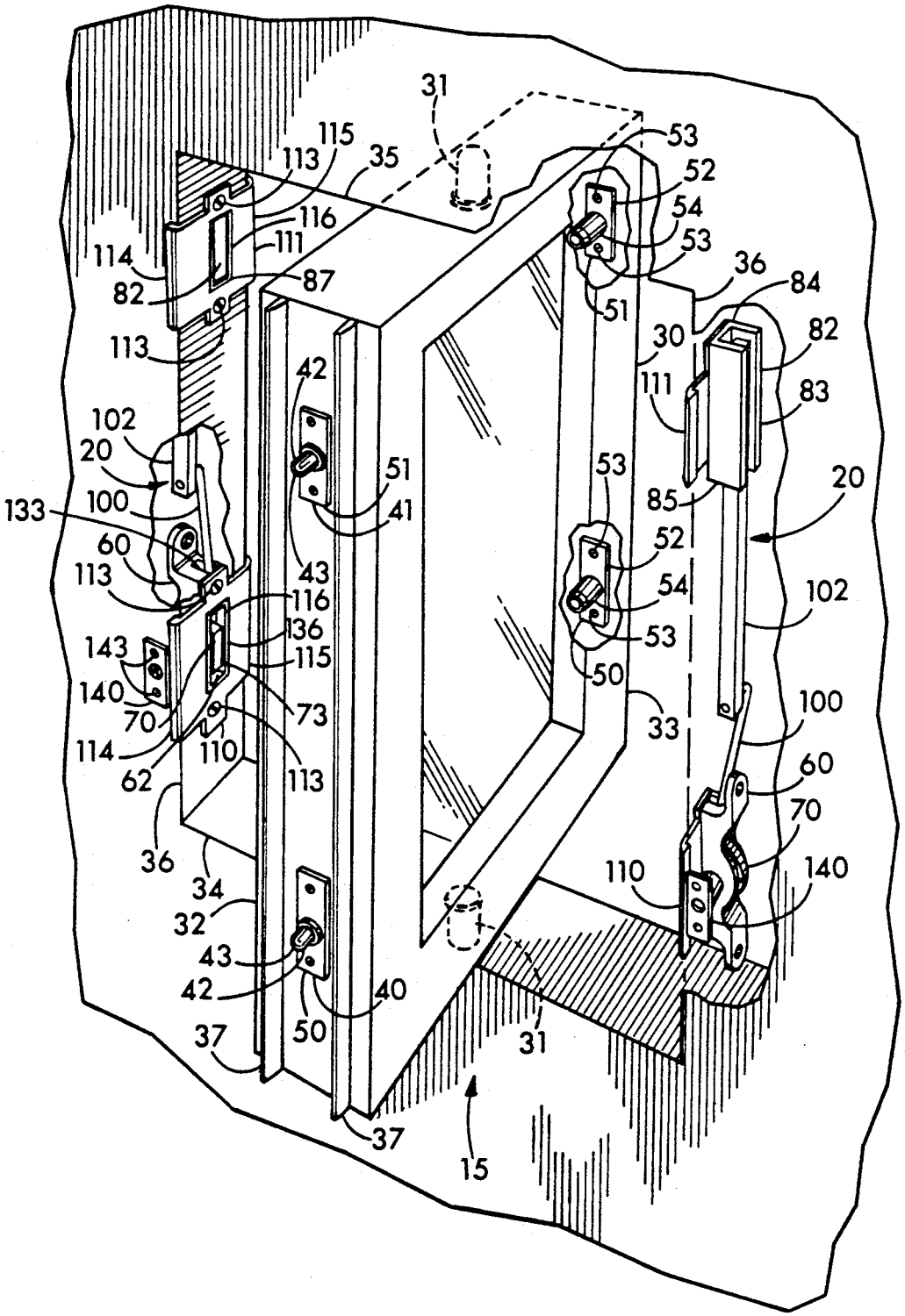
FIG. 1 is a perspective view of a window equipped with the remote window lock assembly of this invention.

Referring more particularly to FIGS. 1–9 wherein like numbers refer to similar parts, a center pivot window 15 equipped with two remote lock assemblies 20 is shown in FIG. 1. The center pivot window 15 has a glass light 18 in a pivoting sash 30 mounted on center pivots 31 within a window frame which has a head 35 and left and right jambs 36. The window sash has two vertical stiles 32, 33 which are aligned with and closely spaced from the jambs of the window frame when the sash 30 is closed. For illustrative purposes, the window 15 has been shown disproportionately small in relation to the remote lock hardware. In a typical window installation of the remote locking assemblies 20 there will be a distance of several feet or more between locking sites on each window frame jamb.

The center pivot window 15 will in most circumstances be kept closed, with the sash 30 being pivoted to an open condition only when it is necessary to clean the exterior surface of the window glass or on other infrequent occasions. When the window is closed, the rubber seals 37 which extend on either side of the sash 30 provide a weatherproof seal around the sash.

A single remote window lock assembly is comprised of two housings 60, 80 spaced vertically one above the other in a window jamb 36, two catch assemblies 40, 41 mounted within the stile of the window sash 30 opposite the housings, and a mechanical linkage connecting the two housings described further below. A window locking assembly 20 is mounted on each of the two vertical stiles of a vertically pivoting window.

Figure 2:
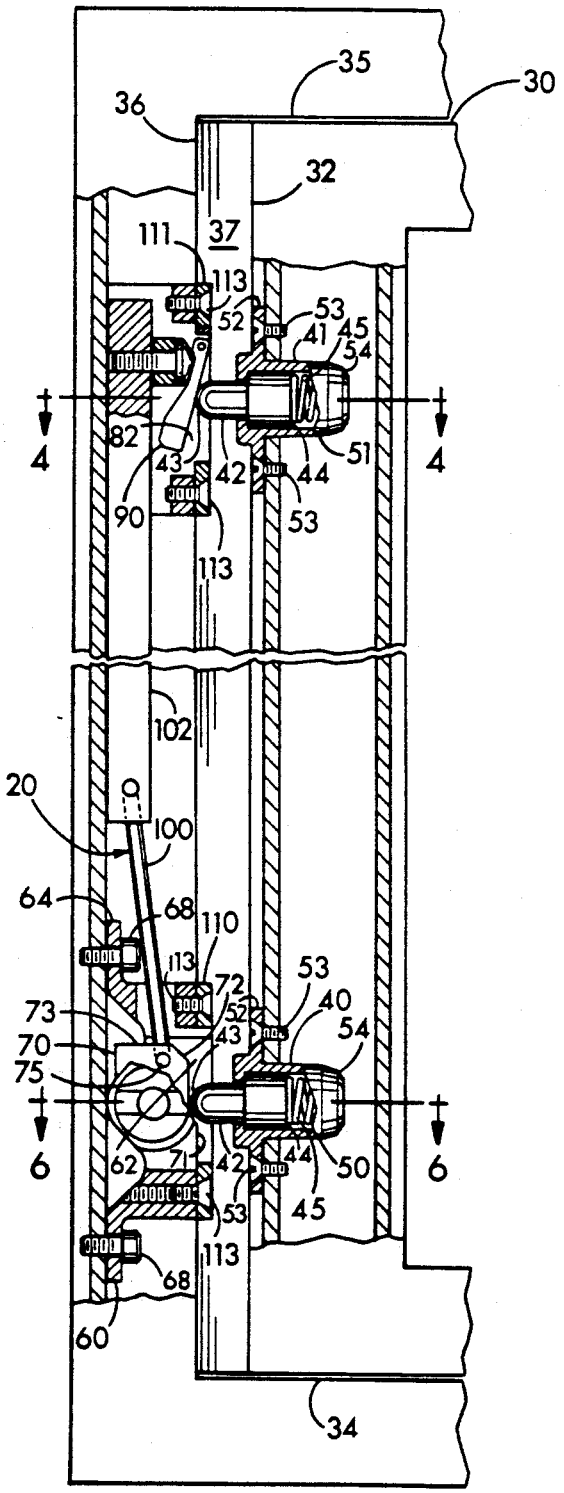
FIG. 2 is a front elevational view partially broken away of the remote window lock assembly of FIG. 1 in a locked position.
Figure 3:
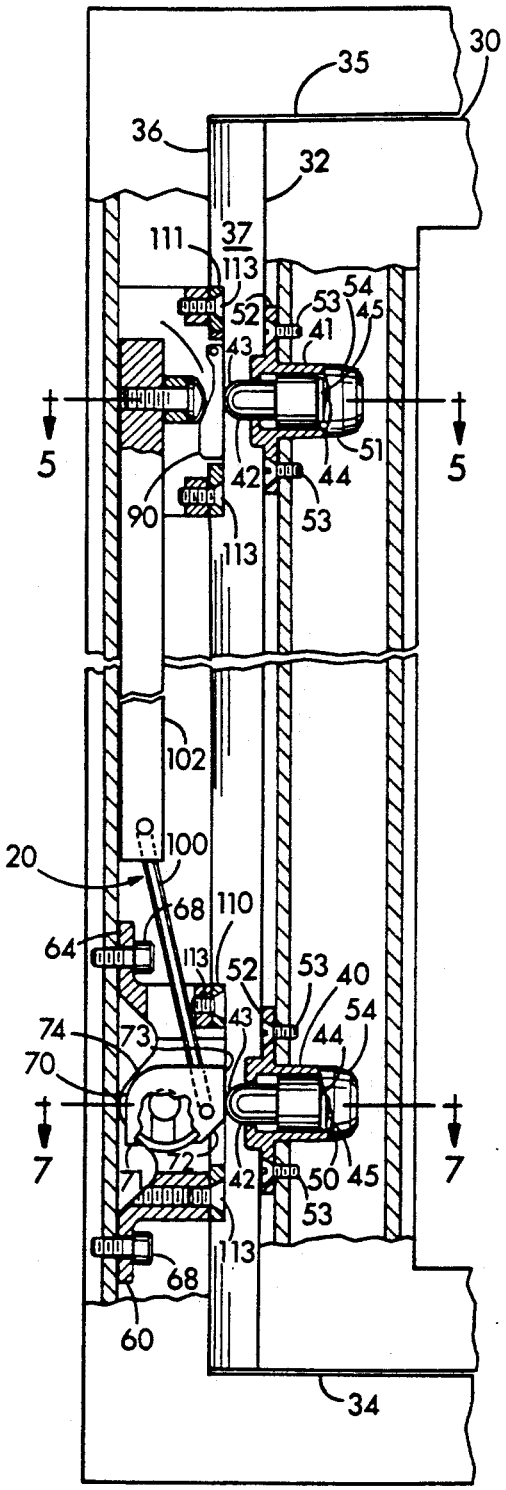
FIG. 3 is a front elevational view partially broken away of the remote window lock assembly of FIG. 1 in an unlocked position.
Figure 4:
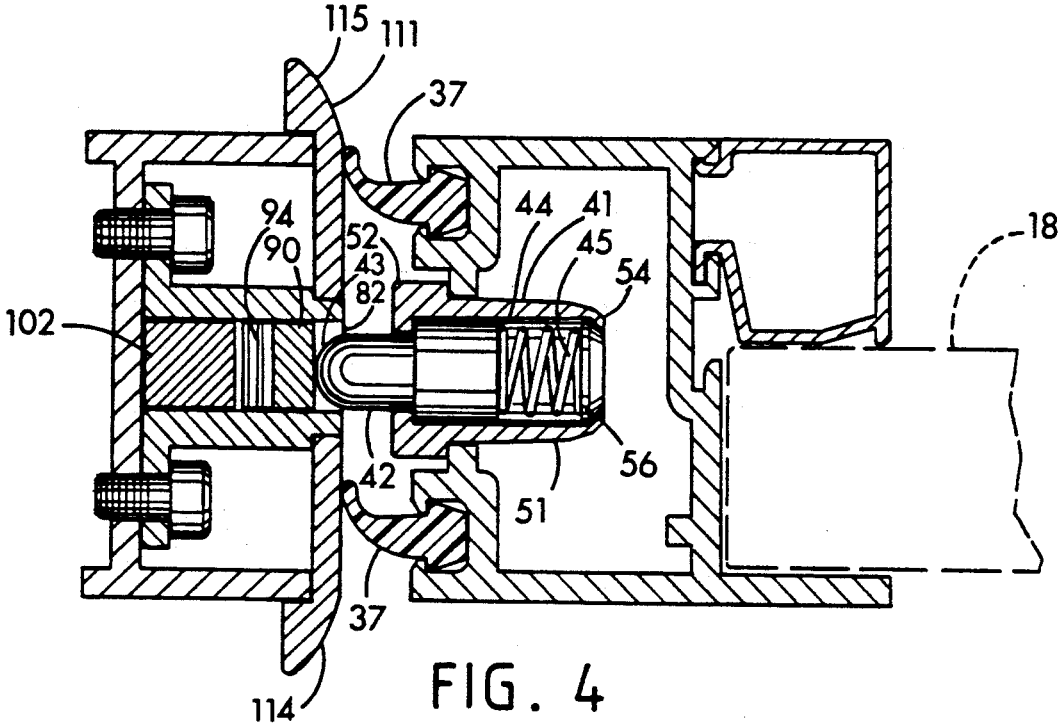
FIG. 4 is a cross-sectional view of the locked remote window lock assembly of FIG. 2 taken along section line 4—4.
Figure 5:
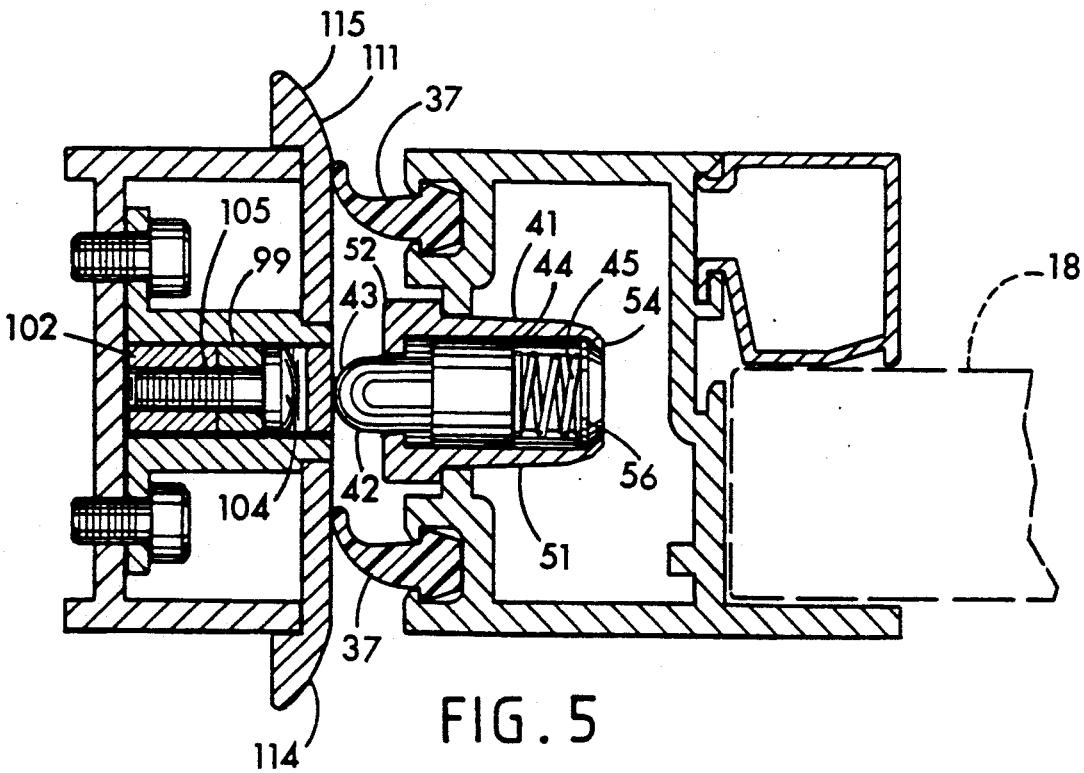
FIG. 5 is a cross-sectional view of the unlocked remote window assembly of FIG. 3 taken along section line 5—5.
Figure 6:
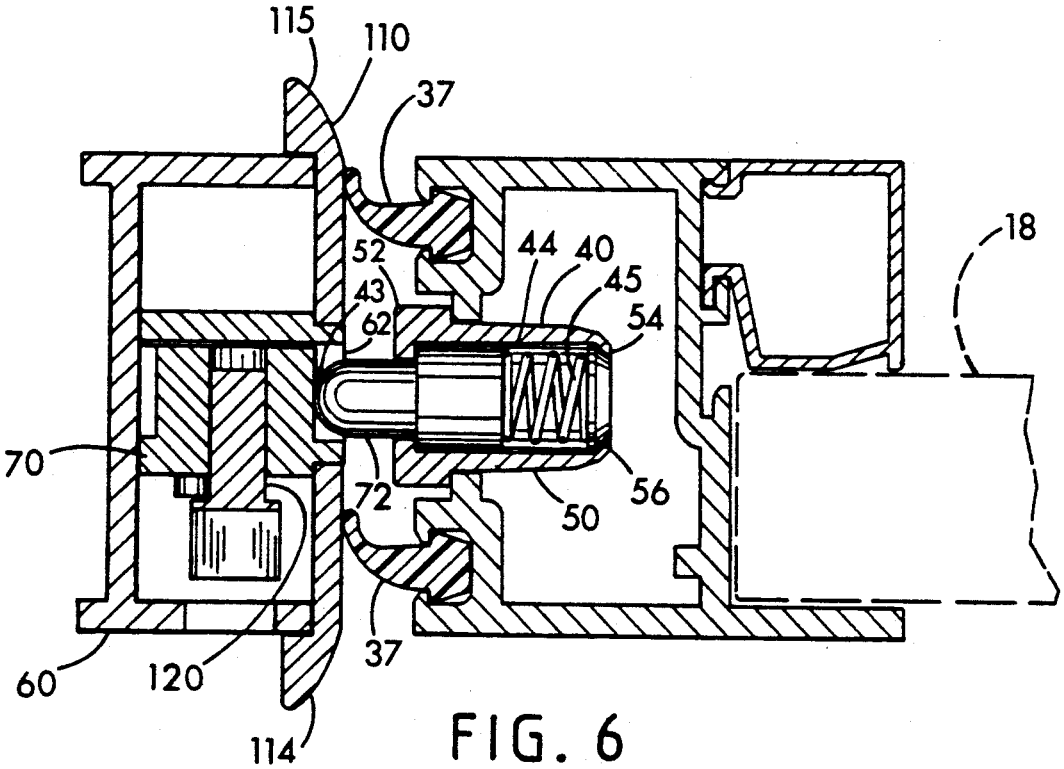
FIG. 6 is a cross-sectional view of the locked remote window lock assembly of FIG. 2 taken along section line 6—6.
Figure 7:
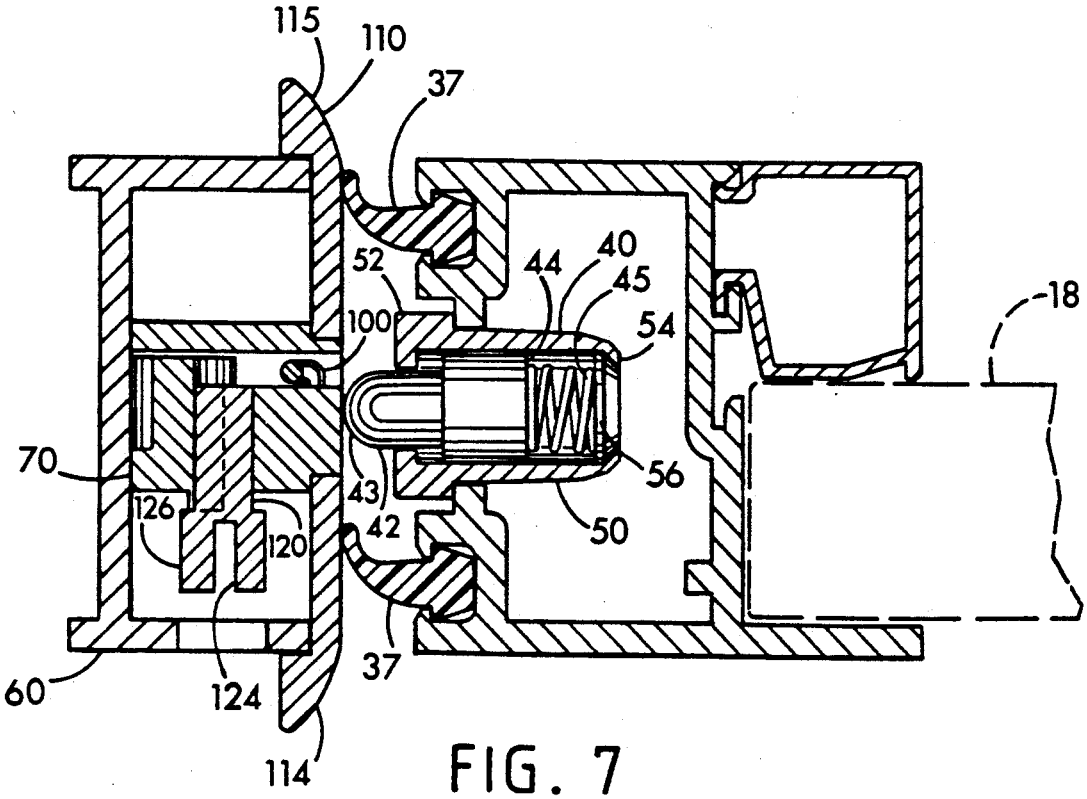
FIG. 7 is a cross-sectional view of the unlocked remote window lock assembly of FIG. 3 taken along section line 7—7.

As best shown in FIGS. 2 and 3, each lock assembly 20 has two resilient catches 40, 41. The resilient catches 40, 41 mount within the vertical stiles 32, 33 of the window sash 30 and have protruding portions or nubs 42 which extend beyond the surface of the stiles 32, 33 and which are spring-loaded and may be depressed into the stiles. Each catch 40, 41 has catch housings 50, 51. The lower catch 40 is located in a position easily accessible to an operator, usually near the window sill 34. The upper catch 41 is located above the lower catch and may, depending on the dimensions of the sash, be out of reach.

The spring-loaded nubs 42 are preferably cylindrical with rounded protruding tops and are generally bullet shaped with a top curved surface 43 and a flat bottom surface 44. The flat surface 44 abuts a spring 45. The top curved surface 43 extends outwardly from the catch housing and is the part that engages within the cam housing recess 62 or the flapper housing recess 82. The flat bottom surface 44 abuts against the spring 45 which is held within the catch housing by a washer 56.

The catch housings 50, 51 have mounting portions 52 with fastener holes 55 for the attachment of the catches by fasteners 53 to the window sash stiles 32, 33. Each catch housing 50, 51 has a cylindrical protruding portion 54 which is recessed into the stile and against which the washer 56 and spring 45 bear.

A cam housing 60 is located in the window jamb 36 opposite the lower resilient catch 40. The cam housing 60 has a recess 62 which engages the nub 42 of the opposite catch 40 when the sash 30 is in a closed position. A flapper housing 80 is located in the window jamb 36 opposite the upper catch 51 and is covered by a flapper housing face plate 111.

The face plates 110, 111 with mounting holes 112 are attached with fasteners 113 to the window frame side jamb 36 in proximity to the cam and flapper housings 60, 80. Each face plate has two radiused sides or ramps 114, 115 which assist the catch device nubs 42 in riding over the face plates into engagement with the housings 60, 80. The face plates 110, 111 have a rectangular opening 116 which fits over the lip 136 of the cam housing recess 62 or the lip 87 of the flapper housing recess 82.

The cam housing 60 is generally a rectangular open box with upper and lower sides 63, 61, each side having a protrusion 64. Portions of each protrusion define a mounting hole 66. A fastener 68 is inserted through each hole 66 to attach the cam housing 60 to the vertical jamb 36 of the window. The upper and lower sides 63, 61 are joined by two parallel sides 130, 131 which are oriented along the vertical frame side jamb 36 of the window.

Figure 8:
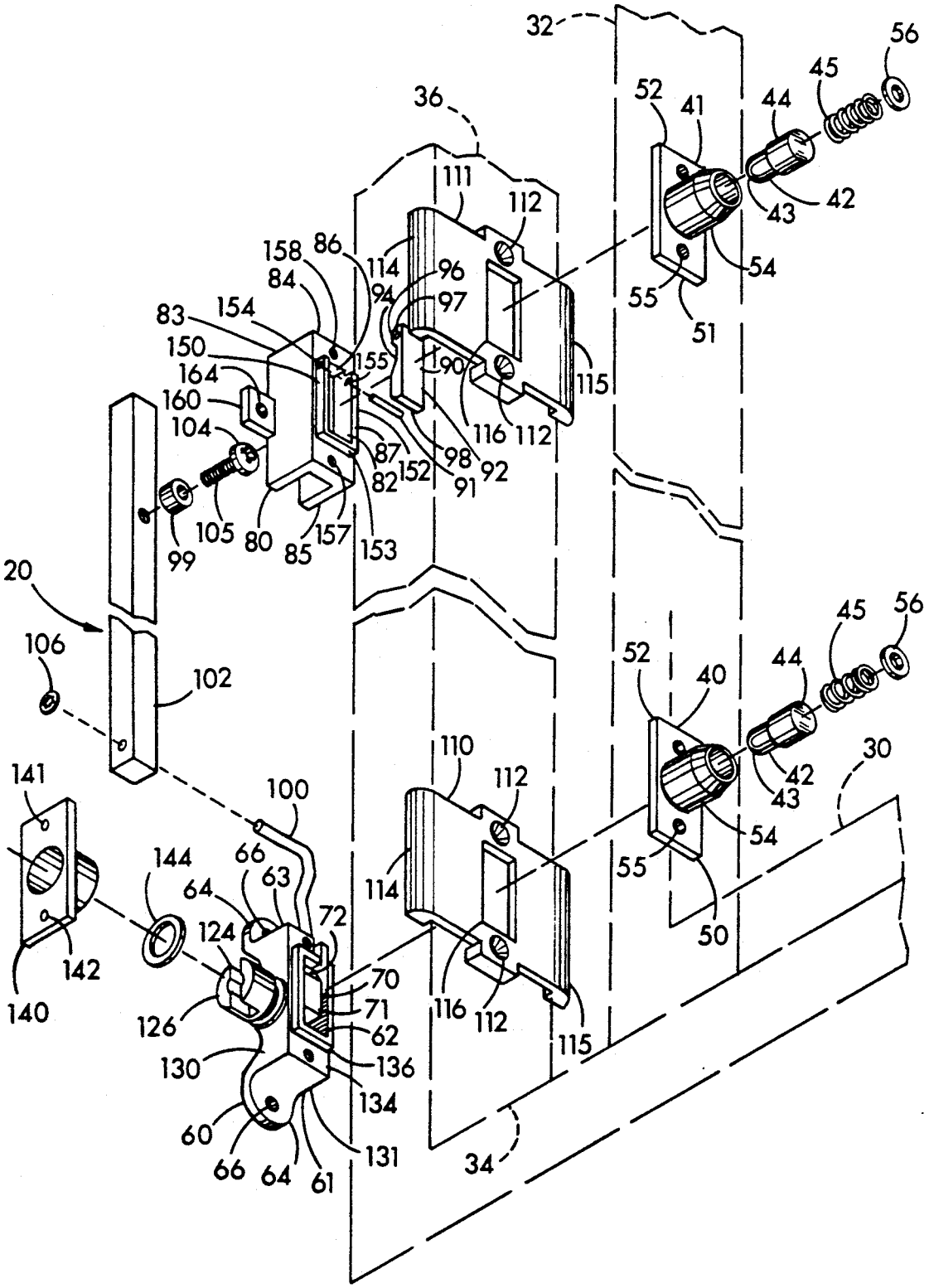
FIG. 8 is an exploded isometric view of the remote window lock assembly of FIG. 1.

As shown in FIG. 8, the upper side 63 has a slot 133 through which a link 100 extends and moves without interference. The cam housing 60 has a front 134, which has an opening 135 which is surrounded by a raised lip 136 protruding from the front 134. The lip 136 protrudes from the front 134 approximately the thickness of the face plate 110. The face plate 110 fits over the raised lip 136 and is aligned with it.

Figure 9:
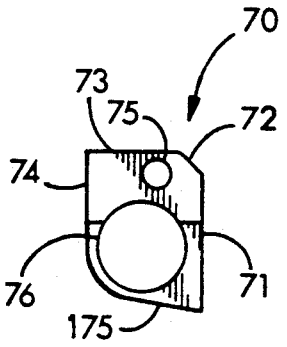
FIG. 9 is a side elevational view of the rotatable cam of the window lock assembly of FIG. 1.

A cam 70, shown in FIG. 9, is rotatably mounted within the cam housing 60 as shown in FIGS. 2 and 3. The cam 70 is rotatable between a locked position, shown in FIG. 2, in which the catch 40 is engaged within the cam housing recess 62 and an unlocked position, shown in FIG. 3, in which portions of the cam 70 move the catch 40 out of the cam housing 60 and out of engagement within the recess 62.

The cam 70, shown in FIG. 9, has four adjacent straight sides of differing lengths 71, 72, 73, 74 and an inclined side 175. The cam has two holes 75, 76 through its thickness. A link hole 75 receives the link 100. The cam shaft hole 76 receives the cam shaft 120. The cam shaft 120 is mated to the key arm 126 which has a key slot 124 which can accept a key or handle (not shown) for operating the remote lock assembly 20.

An exterior cover plate 140 slips over the key arm 126 and has portions defining holes 141, 142 through which screws 143 are inserted to affix the cover plate 140 to the frame of the window 15. The cover plate 140 identifies one of the locking and unlocking sites of the window into which a key (not shown) or handle (not shown) is to be inserted for unlocking and locking the sash 30 within the frame. In the locked position, the cam is oriented with the long side 71 facing the cam housing recess 62 so that the spring-loaded catch 40 rests on the surface 71 of the cam 70.

The distance from the side 71 to the center of the cam shaft is less than the distance from the side 73 to the center of the cam shaft. Hence, when the cam shaft is rotated to turn the cam 70, the catch nub 42, which is engaged against the side 71 when the window is locked, is elevated as it moves across the side 71, up the inclined side 72 to rest engaged against the side 73. The side 73, when rotated into the unlocked position shown in FIG. 3, is at approximately, the same level as the face plate 110.

When the key or handle rotates the key arm 126, the cam 70 is turned so that the short surface 72 moves into the cam housing recess 62 and pushes nub 42 of the spring-loaded catch 40 out of the recess 62. The cam is then turned until the long side 73 is parallel to the face plate 110. As the cam 70 rotates, the link 100 is pulled downward causing the bar 102 to also move downward.

A flapper housing 80 is mounted in the window frame side jamb 36 above the cam housing 60 and opposite the upper catch 41 in the window sash 30.

The flapper housing 80 has a recess 82 which extends into the window jamb 36 beneath the level of the face plate 111 and in which the nub 42 of the catch 41 engages to hold the window in a locked position.

The U-shaped flapper housing 80, best shown in FIG. 8, has two rectangular parallel long opposite sides 83 and 85 and a top 84 extending between and perpendicular to the sides 83 and 85. The center portion of the U defined by the top 84 and sides 83, 85 forms the flapper housing recess 82. The top 84 has a rectangular opening 86 surrounded by a raised lip 87, the height of the lip 87 is approximately equal to the thickness of the face plate 111. The raised lip 87 has portions 150, 152 which extend along two of the sides 83, 85 and a third portion 153 extending between the portions 150, 152. The lip portions 150, 152 have pin holes 154, 155 located therein. The holes 154, 155 are opposite one another and receive a pin 91 which extends through the flapper 90. On either side of the raised lip 87 are fastener holes 157, 158 located on the top 84 to receive fasteners 113 which fasten the face plate 111 to the flapper housing 80. Protruding outward from the sides 150, 152 of the housing are flanges 160 which have fastener holes 164. Fasteners 167 extend through the holes 164 to attach the flapper housing 80 to the vertical side jamb 36.

The U-shaped flapper housing recess 82 is wide enough to hold the bar 102 which has a raised protrusion 104 on it. The sides 83, 85 of the flapper housing guide the travel of the bar 102.

The flapper 90 is pivotally mounted to the flapper housing lip 87 by the pin 91. The flapper 90 is pivotable between a locked position in which the flapper 90 does not block the flapper housing recess 82 and an unlocked position in which the flapper 90 blocks the flapper housing recess 82 and forces the opposing catch 41 out of engagement within the flapper housing 80.

The 90 flapper is generally rectangularly shaped with an outwardly facing surface 92 which engages the locked catch 41, and an inwardly facing surface 94 which engages the protrusion 104 on the bar 102. The flapper has a pin hole 97 in the upper end 96. The lower end 98 hangs below the pin 91 and swings away from and towards the catch 41. The flapper 90 outwardly facing surface 92 is flat. The inwardly facing surface 94 is inclined in portions such that the thickness of the flapper varies along its length, generally being thicker at the lower end 98 than it is beneath the upper end 96.

When the flapper is pressed into the unlocked position by the protrusion 104 on the bar 102, the outwardly facing surface 92 is approximately in the same plane as the face plate 111.

A bent link 100 is pivotally connected to the cam 70. The link 100 extends upwardly out of the cam housing 60 through the slot 133 and provides a means for operatively connecting the bar 102 to the cam 70. As shown in FIG. 8, the link 100 is bent to enable it to extend out of the housing and extend perpendicularly through the bar 102, where it is fastened by a lock washer 106. The bar 102 is pivotally connected to the link 100 above the cam housing 60. The bar slidably extends into the flapper housing 80 into the recess 82 in the open channel of the U. The bar 102 has a protrusion 104 on it. The protrusion is formed by the rounded head of a screw 105. The appropriate spacing of the top of the screw from the bar 102 is provided by a spacer 99. The protrusion 104 extends horizontally and engages the flapper 90. The bar 102 is moveable from a locked, elevated position in which the flapper 90 is in its locked position to an unlocked lowered position in which the bar protrusion 104 presses against the flapper 90 pivoting the flapper 90 into its unlocked position. When the cam 70 is rotated, the link 100, which is pivotally connected to the cam 70, moves linearly upwardly and hence moves the attached bar 102 in a like manner. The protrusion on the bar 104 rides against the surface 94 of the flapper, causing the lower end 99 of the flapper 90 to move in an outward direction from the window frame side jamb 36 toward the sash 30 of the window 15. The rotation of the cam 70 from its locked to its unlocked position hence results in the disengagement of both catches 40, 41 from the window jamb 36.

In the unlocked position, the flapper 90 presses against the nub 42 of the catch 41 and moves it out of the flapper housing recess 82.

When it is desired to open the window 15 for cleaning or other purposes, it is necessary for an operator only to insert a key or handle into the key slot 124 behind the cover plate 140 on each side of the sash 30. By rotating each key arm 126 90° the operator causes all four nubs 42 within the resilient catches 40, 41 to be pushed out of engagement within the window jambs. Once the catches 40, 41 have been disengaged, the vertical pivot window 15 may be opened by pushing on one side of the window. When it is desired to close the windows, the key arms are rotated back to their original locked position and the window sash 30 is pivoted about the pivots 31 until the nubs 42 are engaged once again within the housings 60, 80.

Figure 10:
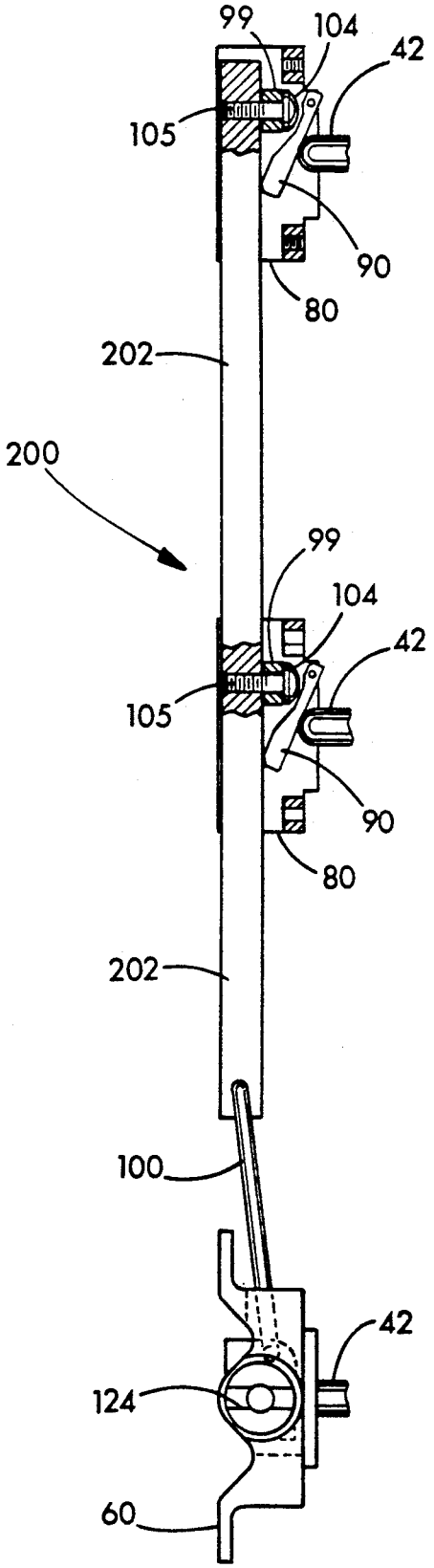
FIG. 10 is a side elevational view of a remote window lock assembly having multiple remotely located catches.

As illustrated in FIG. 10, three catches with nubs 42 may be operated by an operator turning a handle on a single key slot 124. The remote window lock assembly 200 has two flapper housings 80 and an extended length bar 202 which extends into each flapper housing with two protrusions 104 spaced to engage against two flappers 90. By utilizing the assembly 200 a tall pivot window which requires multiple locking sites to maintain a satisfactory seal may easily be operated from a conveniently located position. In a similar manner, further flapper housings and catches may be provided spaced along a lengthened bar 202 to accommodate any desired pivot window installation.

It is important to note that although the catches have been illustrated as spring-loaded nubs, any equivalent resilient catch may be employed, for example, a strip of spring steel, a compressible plastic member, or other such mechanisms. It should be further noted that in particular applications, such as with vertical pivot windows which extend down to the floor, for convenience the window lock assembly may be inverted so that the flapper housings are beneath the cam housings to reduce the need for bending down by an operator to unlock the window.

The means for operatively connecting the rotatable cam and the bar may be a link as described, but the equivalent function may also be performed by providing the bar with a flexible portion such as a chain or other flexible member which connects to the cam. Alternatively, any conventional linkage involving multiple links may be employed; for example, if it is desired to insert some obstruction in the jamb vertically between the cam housing and the flapper housing. It should also be noted that the particular shape of the flapper may be varied to accommodate various catch mechanisms or bar characteristics.

It is understood that the invention is not confined to the particular construction and arrangement of parts herein illustrated and described, but embraces such modified forms that come within the scope of the following claims.

We claim:

1. A lock assembly for a window sash having a vertical stile and pivotable about a vertical axis within a frame, comprising:

a) a plurality of resilient catches adapted for mounting to the vertical stile of a window sash;

b) a cam housing adapted for mounting in a window frame opposite a catch in a window sash, the cam housing having portions defining a recess for engagement of an opposite catch when the sash is in a closed and locked position;

c) a cam located within the cam housing and rotatable between a locked position in which the catch is permitted to engage within the recess and an unlocked position in which portions of the cam force the catch out of the cam housing and out of engagement within the recess;

d) at least one flapper housing adapted for mounting in the window frame above the cam housing and opposite a catch in the window sash, the flapper housing having portions defining a recess adapted to engage and hold the opposite catch;

e) a flapper pivotally mounted to each flapper housing and pivotal between a locked position in which the flapper does not block the flapper housing recess and an unlocked position in which the flapper blocks the flapper housing recess and forces the opposing catch out of engagement within the flapper housing;

f) a bar slidably extending into each flapper housing, the bar having a protrusion thereon which extends horizontally and engages the flapper, wherein the bar may be moved from a locked, elevated position in which the flapper is in its locked position, to an unlocked lowered position in which the bar protrusion presses against the flapper pivoting the flapper into its unlocked position; and g) a means for operatively connecting the cam and the bar, wherein rotation of the cam from its locked to its unlocked position moves the bar from its elevated to its lowered position such that by rotating the cam the resilient catches may be disengaged to permit the opening of a window.

2. The lock assembly of claim 1 wherein each catch comprises a protruding nub spring-loaded within a catch housing adapted for attachment to the sash stile.

3. The lock assembly of claim 1 wherein the flapper housing has walls which define the recess and wherein the bar travels within the walls.

4. The lock assembly of claim 1 further comprising a face plate, generally rectangular in shape, adapted for mounting on the window frame opposite a catch, the face plate having a portion defining an opening into which the catch can engage, the face plate further having a ramp, wherein the catch can ride along the ramp when the window is rotated into a closed position to facilitate the closing of the window and engagement of the catch with the plate opening.

5. The lock assembly of claim 1 wherein each catch has a bullet-shaped nub which has a curved portion and a flat portion, the curved portion of the nub being adapted to engage within a housing recess in the cam housing, and the flat portion of the nub engages a spring.

6. The lock assembly of claim 1 wherein the operatively connecting means comprises a rigid link mounted between the cam and the bar.

7. A lock assembly for a window sash having two vertical stiles and pivotable about a vertical axis within a frame, comprising:

a) a plurality of resilient catches adapted for mounting to the vertical stile of a window sash;

b) a cam housing adapted for mounting in a window frame opposite a catch in a window sash, the cam housing having portions defining a recess for engagement of the opposite catch when the sash is in a closed position;

c) a cam located within the cam housing and rotatable between a locked position in which the catch is permitted to engage within the recess and an unlocked position in which portions of the cam force the catch out of the cam housing and out of engagement within the recess;

d) a plurality of flapper housings, each flapper housing adapted for mounting in the window frame above the cam housing and opposite a catch in the window sash, and each flapper housing having portions defining a recess adapted to engage and hold an opposite catch;

e) a flapper pivotally mounted to each of the flapper housings and pivotal between a locked position in which the flapper does not block the flapper housing recess and an unlocked position in which the flapper blocks the flapper housing recess and forces the opposing catch out of engagement with the flapper housing;

f) a link pivotally connected to the cam and extending upwardly out of the cam housing; and g) a bar pivotally connected to the link above the cam housing and slidably extending into the flapper housings, the bar having a plurality of protrusions thereon, wherein each protrusion extends horizontally and engages one of the flappers, and wherein the bar may be moved from a locked, elevated position in which each of the flappers is in its locked position, to an unlocked lowered position in which the bar protrusions press against the flappers pivoting the flappers into their unlocked positions, and wherein rotation of the cam from its locked to its unlocked position moves the bar from its elevated to its lowered position.

8. A lock assembly for a window sash having a vertical stile and pivotable about a vertical axis within a frame, comprising:

a) a plurality of resilient catches adapted for mounting to the vertical stile of a window sash;

b) a cam housing adapted for mounting in a window frame opposite a catch in a window sash, the cam housing having portions defining a recess for engagement of an opposite catch when the sash is in a closed and locked position;

c) a cam located within the cam housing and rotatable between a locked position in which a catch is permitted to engage within the recess and an unlocked position in which portions of the cam force the catch out of the cam housing and out of engagement within the recess;

d) a flapper housing adapted for mounting in the window frame above the cam housing and opposite a catch in the window sash, the flapper housing having portions defining a recess adapted to engage and hold the opposite catch;

e) a flapper pivotally mounted to the flapper housing and pivotal between a locked position in which the flapper does not block the flapper housing recess and an unlocked position in which the flapper blocks the flapper housing recess and forces the opposing catch out of engagement within the flapper housing;

f) a link pivotally connected to the cam and extending upwardly out of the cam housing;

g) a bar pivotally connected to the link above the cam housing and extending into the flapper housing, the bar being engaged with the flapper, wherein the bar may be moved from a locked, elevated position in which the flapper is in its locked position, to an unlocked lowered position in which the bar engages with the flapper to pivot the flapper into its unlocked position, and wherein rotation of the cam from its locked to its unlocked position moves the bar from its elevated to its lowered position such that by rotating the cam the resilient catches may be disengaged to permit the opening of the window.

9. A pivot window comprising:

a) a window frame having a vertical jamb;

b) a window sash having at least one vertical stile and pivotal about a vertical axis within the window frame between an open position and a closed position in which the vertical stile is parallel to and closely spaced from the vertical jamb;

c) a first and a second resilient catch mounted to the stile, with the second catch mounted above the first catch;

d) a cam housing mounted to the window sash opposite the first catch, the cam housing having portions defining a recess for engagement with the first catch when the sash is in a closed position;

e) a cam located within the cam housing and rotatable between a locked position in which the catch is permitted to engage within the cam housing recess and an unlocked position in which portions of the cam force the catch out of the cam housing and out of engagement within the recess;

f) a flapper housing mounted to the window sash above the cam housing and opposite the second catch, the flapper housing having portions defining a recess adapted to engage and hold the second catch;

g) a flapper pivotally mounted to the flapper housing and pivotal between a locked position in which the flapper does not block the flapper housing recess and an unlocked position in which the flapper blocks the flapper housing recess and forces the second catch out of engagement with the flapper housing;

h) a link pivotally connected to the cam and extending upwardly out of the cam housing; and i) a bar pivotally connected to the link above the cam housing and slidably extending into the flapper housing, the bar having a protrusion thereon which extends horizontally and engages the flapper, wherein the bar may be moved from a locked, elevated position in which the flapper is in its locked position, to an unlocked lowered position in which the bar protrusion presses against the flapper pivoting the flapper into its unlocked position, and wherein rotation of the cam from its locked to its unlocked position moves the bar from its elevated to its lowered position such that rotation of the cam disengages the resilient catches from the window jamb to permit the window sash to be pivoted to an open position.

10. The pivot window of claim 9 further comprising a face plate, generally rectangular in shape, mounted on the window frame opposite a catch, the face plate having a portion defining an opening into which the catch can engage, the face plate further having a ramp, wherein the catch can ride along the ramp when the window is rotated into a closed position to facilitate the closing of the window and engagement of the catch with the plate opening.

11. The pivot window of claim 9 wherein each catch has a bullet-shaped nub which has a curved portion and a flat portion, the curved portion of the nub being adapted to engage within a recess in the cam housing, and the flat portion of the nub engages a spring.

12. The pivot window of claim 9 wherein the flapper housing has walls which define the recess and wherein the bar travels within the walls.

13. The window of claim 9 wherein the sash has two parallel stiles and the frame has two parallel jambs; and flapper housings and flappers, cam housings and cams, are located in both jambs and catches are located in both stiles opposite the housings.

14. The pivot window of claim 9, further comprising:

a) a third resilient catch mounted to the vertical stile of the window sash above the second catch;

b) a second flapper housing mounted in the window jamb above the cam housing and opposite the third catch in the window sash, the flapper housing having portions defining a recess adapted to engage and hold the third catch; and c) a flapper pivotally mounted to the second flapper housing and pivotal between a locked position in which the flapper does not block the flapper housing recess and an unlocked position in which the flapper blocks the flapper housing recess and forces the third catch out of engagement with the flapper housing; wherein the bar connected to the link extends into both flapper housings and wherein the bar has a second protrusion which extends horizontally and engages a second flapper, and wherein the bar may be moved from a locked, elevated position in which the flappers are in locked positions, to an unlocked lowered position in which the bar protrusions press against the flappers pivoting the flappers into their unlocked position.

15. A lock assembly for a window sash having two vertical stiles and pivotable about a vertical axis within a frame, comprising:

a) a plurality of resilient catches adapted for mounting to the vertical stile of a window sash;

b) a plurality of flapper housings adapted for mounting in the window frame in vertically spaced relation and opposite a catch in the window sash, the flapper housings having portions defining a recess adapted to engage and hold an opposite catch;

c) a flapper pivotally mounted to each of the flapper housings and pivotal between a locked position in which the flapper does not block the flapper housing recess and an unlocked position in which the flapper blocks the flapper housing recess and forces the opposing catch out of engagement with the flapper housing;

d) a bar slidably extending into the flapper housings, the bar having a plurality of protrusions thereon, wherein the protrusions extend horizontally and each flapper is engaged by a protrusion and wherein the bar may be moved from a locked, elevated position in which each of the flappers is in its locked position, to an unlocked lowered position in which the bar protrusions press against the flappers pivoting the flappers into their unlocked positions to allow pivoting of the window sash.

* * * * *